US008480213B2

(12) United States Patent
Akiyama et al.

(10) Patent No.: US 8,480,213 B2
(45) Date of Patent: Jul. 9, 2013

(54) LIQUID CONTAINING TANK, LIQUID-JET HEAD UNIT, AND IMAGE FORMING APPARATUS

(75) Inventors: Yoshitaka Akiyama, Kanagawa (JP); Hirotaka Kobayashi, Tokyo (JP); Mitsuru Kawakami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 328 days.

(21) Appl. No.: 12/944,846

(22) Filed: Nov. 12, 2010

(65) Prior Publication Data

US 2011/0128334 A1 Jun. 2, 2011

(30) Foreign Application Priority Data

Nov. 27, 2009 (JP) ..... 2009-269876

(51) Int. Cl.
*B41J 2/175* (2006.01)
*B41J 2/18* (2006.01)

(52) U.S. Cl.
USPC ..... 347/85; 347/86; 347/89

(58) Field of Classification Search
USPC ..... 347/85, 86, 89, 93, 94
See application file for complete search history.

(56) References Cited

U.S. PATENT DOCUMENTS

| | | | |
|---|---|---|---|
| 5,030,973 | A | 7/1991 | Nonoyama et al. |
| 7,055,941 | B2 | 6/2006 | Tsurui et al. |
| 2009/0009575 | A1 | 1/2009 | Tonami et al. |
| 2009/0284572 | A1 | 11/2009 | Katoh |
| 2010/0260422 | A1 | 10/2010 | Ito et al. |

FOREIGN PATENT DOCUMENTS

| | | |
|---|---|---|
| JP | 2797191 | 7/1998 |
| JP | 2006-82485 | 3/2006 |
| JP | 4125250 | 5/2008 |
| JP | 2008-194982 | 8/2008 |
| JP | 2009-12316 | 1/2009 |
| JP | 2009-152827 | 7/2009 |

*Primary Examiner* — Jannelle M Lebron
(74) *Attorney, Agent, or Firm* — Cooper & Dunham LLP

(57) ABSTRACT

A liquid containing tank for containing a liquid to be supplied to a liquid-jet head. The liquid containing tank includes a containing part containing the liquid supplied from the outside; and a supply channel separated from the containing part by a partition wall rising from the bottom surface of the containing part and supplying the liquid from the containing part to the liquid-jet head. The containing part includes a first region and a second region, the flow speed of the liquid in the first region of the containing part is lower than the flow speed of the liquid in the second region of the containing part, and the horizontal cross sectional area of the first region of the containing part is less than the horizontal cross sectional area of the second region of the containing part.

11 Claims, 16 Drawing Sheets

LIQUID CONTAINING TANK, LIQUID-JET HEAD UNIT, AND IMAGE FORMING APPARATUS

BACKGROUND OF THE INVENTION

1. Field of the Invention

A certain aspect of the present invention relates to a liquid containing tank, a liquid-jet head unit, and an image forming apparatus.

2. Description of the Related Art

A liquid-jet image forming apparatus such as an inkjet recording apparatus includes one or more recording heads (liquid-jet heads) for jetting liquid droplets. A liquid-jet image forming apparatus is used, for example, for a printer, a facsimile machine, a copier, a plotter, and a multifunction peripheral having functions of them. Such a liquid-jet image forming apparatus jets liquid droplets from its recording heads onto paper being conveyed ("paper" in the present application is not limited to a sheet of paper but also refers to any medium, such as an OHP sheet, to which ink droplets or other liquid droplets can adhere, and may also be called a recording medium, recording paper, recording sheet, etc.), and thereby forms (records or prints) an image on the paper. There are roughly two types of liquid-jet image forming apparatuses: a serial-type image forming apparatus including a recording head that jets liquid droplets while moving in the main-scanning direction to form an image; and a line-type image forming apparatus including a line-type recording head that remains stationary while jetting liquid droplets to form an image.

In the present application, a liquid-jet image forming apparatus refers to an apparatus that forms an image by jetting liquid droplets onto a recording medium made of paper, thread, fabric, textile, leather, metal, plastic, glass, wood, ceramic, or so on. "Image forming" indicates not only a process of forming a meaningful image such as a character or a drawing on a recording medium, but also a process of forming a meaningless image such as a pattern on a recording medium (or just jetting liquid droplets onto a recording medium). "Ink" refers not only to ink (colored liquid) in a general sense, but also to any liquid usable for image forming such as a recording liquid, a fixer solution, a DNA specimen, a resist, a pattern material, and resin. Also, an "image" refers not only to a two-dimensional image, but also to three-dimensional graphics and an image formed on a three-dimensional object.

In an ink supply method employed by some inkjet recording apparatuses, a sub tank is provided on the recording head and a main tank is provided in/on the main body; and ink is supplied from the main tank to the sub tank, and from the sub tank to the recording head.

In such an ink supply method, a supply tube is used to supply ink from the main tank to the sub tank. With this configuration, when ink is to be jetted from the recording head, the ink flowing through the supply tube and having an inertial force is directly supplied to the recording head. The inertial force of ink changes when the amount of ink flowing through the supply tube changes according to the change in the amount of ink to be jetted. This change in the inertial force of ink changes the amount and speed of ink jetted from the recording head. The change in the amount of ink results in the variation of an area occupied by the ink jetted onto paper, and the change in the jetting speed of ink changes the positions of ink droplets jetted onto paper. These changes may lead to reduced print quality.

In a serial-type image forming apparatus, an inertial force is applied to ink flowing through a supply tube or ink in a sub tank due to the movement of the recording head in the main-scanning direction. Since the recording head moves back and forth in the main-scanning direction, positive and negative inertial forces of ink are constantly transmitted to the recording head and this in turn causes the amount of jetted ink and the jetting speed of ink to vary.

In trying to solve the above problems, Japanese Patent No. 2797191 proposes a pressure dumper for a sub tank. The pressure dumper includes a flexible film that absorbs the pressure fluctuation of ink flowing into an inkjet head. Also, Japanese Patent Application Publication No. 2009-152827 proposes a sub tank that is divided into separate chambers by partition walls. A flexible film is provided for each of the chambers to prevent pressure fluctuation of ink supplied to an inkjet head.

Here, a liquid to be jetted from a liquid-jet head is generally a mixture of multiple materials. Also, a typical liquid-jet head unit for jetting a liquid uses a main tank to store the liquid. If the liquid is left in the main tank for a while, components of the liquid are separated and settle at the bottom of the liquid (sedimentation). Japanese Patent Application Publication No. 2006-82485 discloses a main tank configured to prevent the sedimentation of components. The disclosed main tank is configured such that its horizontal area decreases as it becomes closer to the bottom and includes a radiator plate near the top. This configuration makes it possible to stir a liquid in the main tank by the convection caused by the temperature difference of the liquid itself without using a dedicated part such as a rotor for stirring the liquid.

However, the pressure dumper disclosed in JP2797191 requires a communicating path from a filter to a pressure absorbing part, a bubble discharge path, a bubble discharge tube, a dummy nozzle, and a channel for suctioning air bubbles using a purging unit to remove air bubbles from ink in the sub tank. Thus, the pressure dumper of JP2797191 has a complicated configuration and increases the production costs.

With the sub tank disclosed in JP2009-152827, the uniform flow of ink in the sub tank is disturbed by the partition walls dividing the sub tank into separate chambers and as a result, the ink stagnates at the bottom of the sub tank and at the partition walls. Here, pigmented ink having a high light resistance is widely used for inkjet printers. Pigmented ink is generally composed of a pigment, a dispersant, and a solvent. If such pigmented ink stagnates for a long period of time, pigment particles in the pigmented ink separate from the solvent and settle at the bottom. Even with an ink including no pigment, if the ink stagnates for a long period of time, volatile components of the ink separate from the ink and the viscosity of the ink increases. This increase in the viscosity of ink increases the channel resistance and makes it difficult to stably supply the ink to the recording head. This in turn makes it difficult to stably jet ink from the recording head. To prevent the above problems, it is necessary to replace ink in the sub tank by performing a dedicated maintenance process where ink not used for printing is supplied to the sub tank at regular intervals and ink remaining in the sub tank is discharged via an ink discharge path.

The main tank disclosed in JP2006-82485 is configured such that a liquid in the main tank is stirred by the convection caused by the temperature difference of the liquid itself. However, since a sub tank includes many barriers, such as partition walls for dividing the sub tank into separate chambers, that complicate the flow of the liquid, it is not possible to sufficiently stir the liquid in the sub tank by the natural convection of the liquid.

SUMMARY OF THE INVENTION

In an aspect of this disclosure, there is provided a liquid containing tank containing a liquid to be supplied to a liquid-jet head. The liquid containing tank includes a containing part containing the liquid supplied from the outside; and a supply channel separated from the containing part by a partition wall rising from the bottom surface of the containing part and supplying the liquid from the containing part to the liquid-jet head. The containing part includes a first region and a second region, the flow speed of the liquid in the first region of the containing part is lower than the flow speed of the liquid in the second region of the containing part, and the horizontal cross sectional area of the first region of the containing part is less than the horizontal cross sectional area of the second region of the containing part.

DESCRIPTION OF THE PREFERRED EMBODIMENTS

Figure 1:
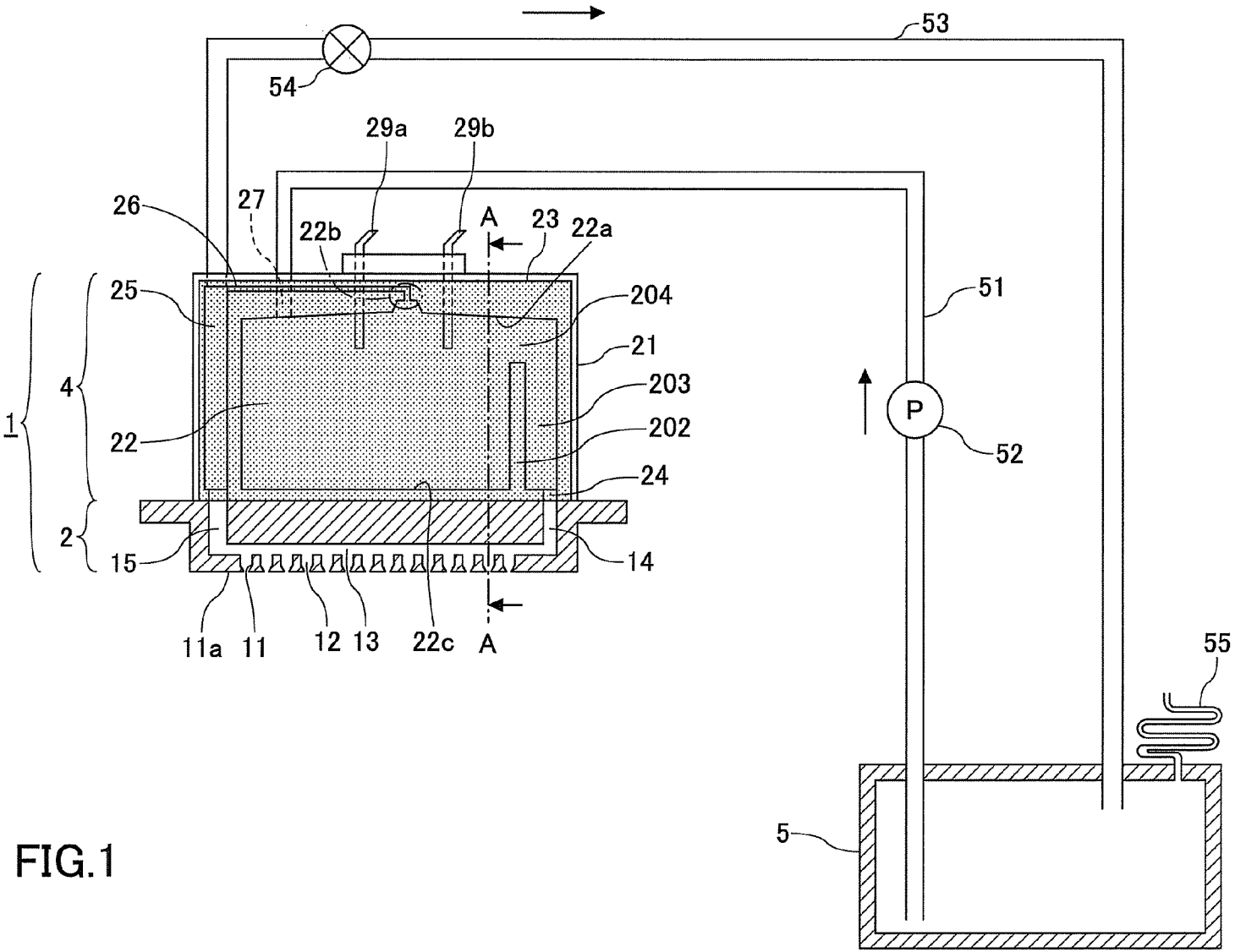
FIG. 1 is a drawing illustrating an ink supply system including a liquid-jet head unit according to a first embodiment of the present invention.
Figure 2:
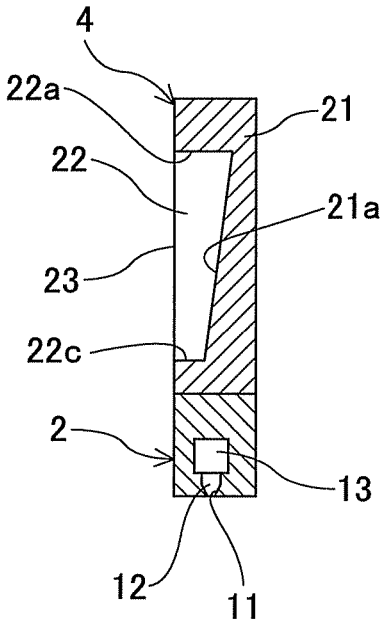
FIG. 2 is a cross-sectional view of a liquid-jet head unit shown in FIG. 1 taken along line A-A.

Preferred embodiments of the present invention are described below with reference to the accompanying drawings. A first embodiment of the present invention is described below with reference to FIGS. 1 and 2. FIG. 1 is a drawing illustrating an ink supply system including a liquid-jet head unit 1 according to the first embodiment; and FIG. 2 is a cross-sectional view of the liquid-jet head unit 1 shown in FIG. 1 taken along line A-A.

The liquid-jet head unit 1 includes a head 2 for jetting liquid droplets and a sub tank (liquid containing tank) 4 for containing ink to be supplied to the head 2.

The head 2 includes nozzles 1 jetting liquid droplets, liquid chambers 12 communicating with the nozzles 11, a common liquid chamber 13 supplying ink to the liquid chambers 12, a supply port (ink supply port) 14 supplying ink to the common liquid chamber 13, and a discharge port (ink discharge port) 15 discharging ink from the common liquid chamber 13.

The sub tank 4 includes a tank case 21. A recess is formed in one side of the tank case 21. The recess forms an ink containing part 22 for containing ink to be supplied to the head 2. The tank case 21 also includes a supply port 24 supplying ink from the ink containing part 22 to the ink supply port 14 of the head 2 and a discharge path 25 discharging ink discharged from the ink discharge port 15 of the head 2 to the outside. The ink containing part 22 includes a top surface 22*a* sloping toward its center. A communicating path 26 is provided to connect an uppermost part 22*b* at the center of the top surface 22*a* of the ink containing part 22 and the ink discharge path 25. The fluid resistance of the communicating path 26 is greater than the fluid resistance of a path from the ink supply port 14 to the ink discharge port 15 of the head 2.

The tank case 21 also includes a supply channel 203 between the ink containing part 22 and the supply port 24. The ink containing part 22 and the supply channel 203 are separated from each other by a partition wall 202 extending (rising) from a bottom surface 22*c* of the ink containing part 22 and are connected via a communicating path 204 formed between the partition wall 202 and the top surface 22*a*.

The tank case 21 (or the recess formed in the tank case 21) of the sub tank 4 has an opening on one side. The opening is closed by a flexible film (damper part) 23 (indicated by a shaded area in FIG. 1) that is capable of elastic deformation and absorbs pressure fluctuations. Thus, the tank case 21 is configured such that the ink containing part 22 and the supply channel 203 separated by the partition wall 202 both function as dampers for absorbing pressure caused by the vibration of ink.

An ink supply channel port 27 for supplying ink from the outside to the ink contained part 22 is provided at the top of the tank case 21.

Referring to FIG. 2, a side surface 21*a* of the recess forming the ink containing part 22 of the tank case 21 slopes upward from the bottom surface 22*c* (a part closest to the head 2) such that the depth of the recess increases toward the top surface 22*a*. In other words, the area of the horizontal cross section (hereafter called the horizontal cross sectional area) of the ink containing part 22 decreases gradually in a direction from the top surface 22*a* toward the bottom surface 22*c* of the ink containing part 22 and becomes the smallest at the bottom surface 22*c*. When ink is supplied from the ink supply channel port 27 at the top of the tank case 21, the flow speed of the ink near the bottom surface 22*c* of the ink containing part 22 becomes slower than that near the top surface 22*a* because of a space formed between the partition wall 202 and a wall facing the partition wall 202. The ink containing part 22 is configured such that its horizontal cross sectional area near the bottom surface 22*c* where the flow speed of ink is lower becomes smaller than the horizontal cross sectional area near the top surface 22*a* where the flow speed of ink is higher.

A replaceable main tank (ink cartridge) 5 is provided on the main body (of an image forming apparatus) to supply ink to the sub tank 4. Ink is supplied by an ink supply pump 52 from the main tank 5 via an ink supply channel 51 to the sub tank 4. The discharge path 25 of the sub tank 4 is connected via an ink return channel 53 to the main tank 5. A valve 54 is provided in the ink return channel 53.

An atmospheric vent tube 55 is provided for the main tank 5 to prevent drying and solidification of ink in the main tank 5 due to long-time exposure of the ink to the external air. The atmospheric vent tube 55 has a long narrow shape. Since the humidity in the atmospheric vent tube 55 changes along its length, the atmospheric vent tube 55 prevents direct contact of the ink in the main tank 5 with the external air and thereby prevents drying, thickening, and solidification of the ink.

In the ink supply system described above, ink contained in the sub tank 4 is supplied via the supply port 24 and the ink supply port 14 at one end of the head 2 to one end of the common liquid chamber 13. A portion of the ink that is supplied to the common liquid chamber 13 but is not jetted from the head 2 is returned via the ink discharge port 15 at the other end of the common liquid chamber 13, the ink discharge path 25, and the ink return channel 53 to the main tank 5. Thus, a circulating path for ink is formed in the ink supply system. The flow of ink returning via the ink return channel 53 to the main tank 5 can be stopped by using the valve 54.

Figure 3:
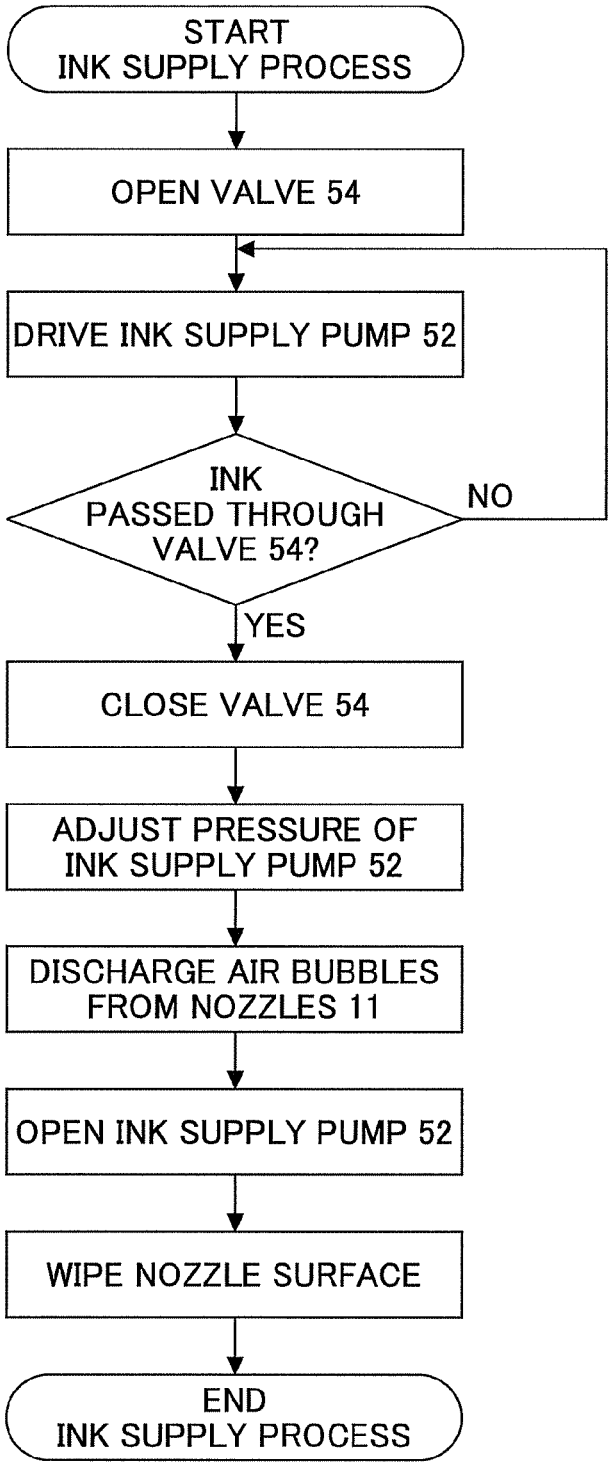
FIG. 3 is a flowchart showing a process of supplying ink to a liquid-jet head in the ink supply system of FIG. 1.

Next, an ink supply process of supplying ink to the head 2 in the ink supply system of this embodiment is described with reference to FIG. 3.

The valve 54 is opened and the ink supply pump 52 is driven to supply ink from the main tank 5 via the ink supply channel 51 to the sub tank 4. The ink supplied to the sub tank 4 flows via the ink supply channel port 27 into the ink containing part 22. A part of the ink is then supplied to the head 2. Meanwhile, when the ink is supplied into the ink containing part 22 of the sub tank 4, the air in the ink containing part 22 is discharged via the communicating path 26 connecting the ink containing part 22 and the ink discharge path 25 into the ink discharge path 25. The ink containing part 22 is filled with the ink up to the uppermost part 22*b* of the top surface 22*a*. The ink also flows into the communicating path 26 and reaches the ink discharge path 25.

The ink supplied to the head 2 flows via the ink supply port 14 into the common liquid chamber 13. A portion of the ink flowing into the common liquid chamber 13 is discharged from the nozzles 11. The other portion of the ink in the common liquid chamber 13 flows via the ink discharge port 15 into the ink discharge path 25 and joins the ink flowing out of the communicating path 26. The joined ink flows into the ink return channel 53 and returns to the main tank 5.

After the ink flows into the ink return channel 53 and passes through the valve 54, the valve 54 is closed. Thereafter, the pressure of the ink supply pump 52 is adjusted to discharge ink from the nozzles 11 of the head 2 and thereby to discharge air bubbles from the nozzles 11. Next, the ink supply pump 52 is opened to stop the flow of ink so that a negative pressure necessary to prevent ink from dripping is generated by the difference in the pressure head between the main tank 5 and the nozzles 11 of the head 2.

Then, a nozzle surface 11*a* is wiped by a wiping part (not shown) made of an elastic material such as silicon rubber to remove ink on the nozzle surface 11*a* and to form menisci in the nozzles 11.

Through the above process, ink is constantly supplied from the main tank 5 via the sub tank 4 to the head 2 to enable the head 2 to jet ink.

When ink is jet from the head 2, additional ink is supplied from the main tank 5 to the liquid chambers 12 of the head 2 due to the meniscus retaining force generated in the nozzles 11. Accordingly, when ink is supplied from the main tank 5 to the liquid chambers 12, ink also flows into and out of the sub tank 4. Ink flows via the ink supply channel port 27 into the ink containing part 22 and then flows via the communicating path 204 into the supply channel 203. In this process, a flow of ink through the shortest route from the ink supply channel port 27 to the supply channel 203 is generated.

The flow speed of ink flowing through the shortest route from the ink supply channel port 27 to the supply channel 203 in the ink containing part 22 changes according to the pressure difference between the ink supply port 24 and the ink supply channel port 27 which depends on the amount of ink jetted from the nozzles 11. That is, as the amount of jetted ink becomes larger, the pressure difference increases and the flow speed of ink flowing through the ink containing part 22 increases; and as the amount of jetted ink becomes smaller, the pressure difference decreases and the flow speed of ink flowing through the ink containing part 22 decreases.

The communicating path 204 connecting the ink containing part 22 and the supply channel 203 is formed by the partition wall 202 rising from the bottom surface 22*c* of the ink containing part 22. Therefore, the flow speed of ink flowing near the bottom surface 22*c* of the ink containing part 22 is slower than the flow speed of ink flowing near the top surface 22*a* of the ink containing part 22. For this reason, when the amount of ink jetted from the nozzles 11 is small, the ink near the bottom surface 22*c* of the ink containing part 22 stagnates. Assuming that a pigmented ink is used, if the stagnant ink is unattended for a long period of time, pigment particles in the ink separate from the solvent and settle at the bottom. Even when an ink including no pigment is used, if the ink stagnates for a long period of time, the viscosity of the ink tends to increase.

As described above, the sub tank 4 of this embodiment is configured such that the horizontal cross sectional area of the ink containing part 22 decreases gradually in a direction from the top surface 22*a* toward the bottom surface 22*c* and becomes the smallest at the bottom surface 22*c*. This configuration makes it possible to generate a flow of ink even near the bottom surface 22*c* of the ink containing part 22 where the flow speed is slow and thereby to prevent stagnation of ink. In other words, this configuration makes it possible to prevent stagnation of ink in the ink containing part 22 through a normal ink jetting process and thereby eliminates the need to perform a dedicated maintenance process to prevent stagnation of ink.

Figure 4:
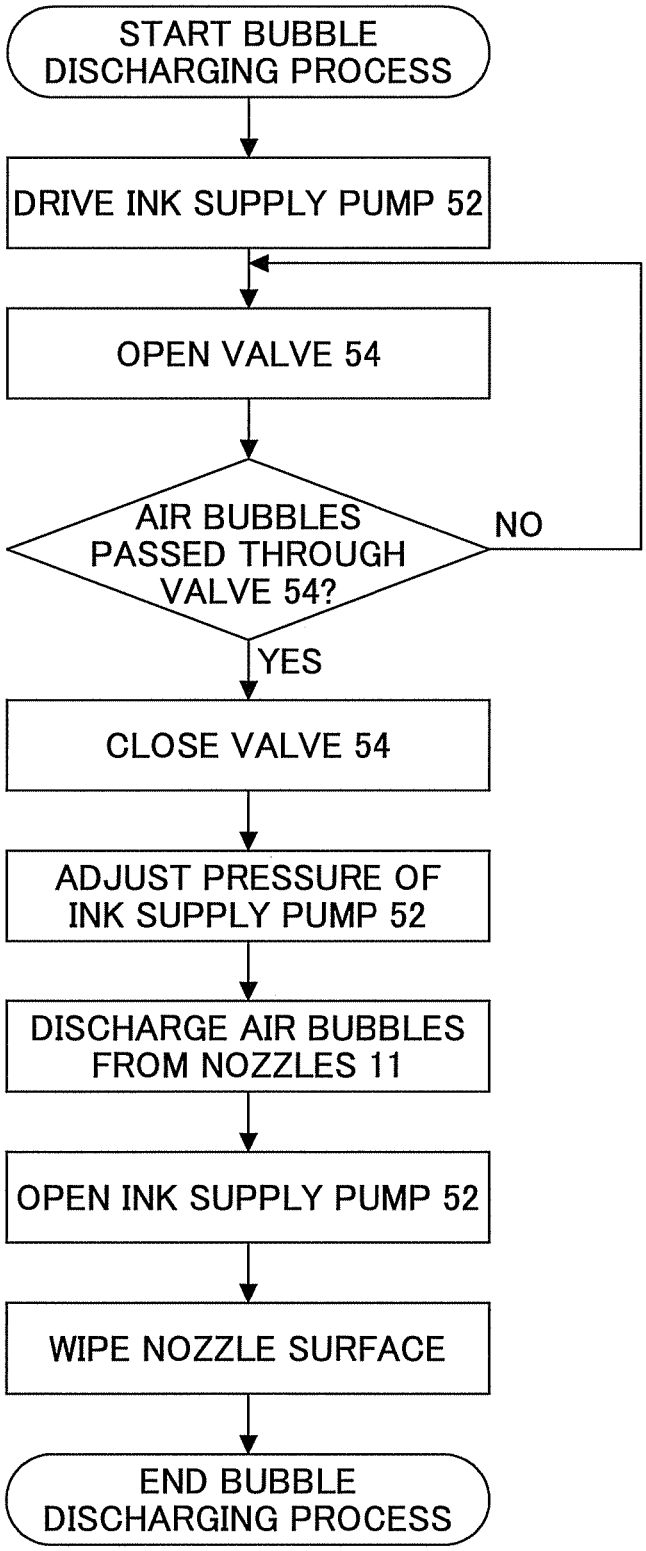
FIG. 4 is a flowchart showing a process of discharging air bubbles from the ink supply system of FIG. 1.

Next, a bubble discharging process of discharging air bubbles from the ink supply system is described with reference to FIG. 4.

The bubble discharging process is performed, for example, when air bubbles enter ink channels/paths and the ink containing part 22 for some reasons and the ink-jet performance of the nozzles 11 is reduced. Air bubbles may enter, for example, from the nozzles 11 or when the main tank 5 is replaced.

In the bubble discharging process, the ink supply pump 52 is driven to supply ink to the sub tank 4 and the valve 54 is opened immediately thereafter. As a result, the ink flows via the ink supply channel port 27 into the ink containing part 22 and if air bubbles are in the ink supply channel 51, the air bubbles also flow into the ink containing part 22 and accumulate near the top of the ink containing part 22. As more ink flows into the ink containing part 22, the pressure in the ink containing part 22 increases and the air bubbles near the top of the ink containing part 22 are discharged via the communicating path 26 into the ink discharge path 25. The ink also flows from the ink containing part 22 to the head 2. If air bubbles are in the common liquid chamber 13, the air bubbles are discharged into the ink discharge path 25. The ink discharged into the ink discharge path 25 flows into the ink return channel 53 and returns to the main tank 5.

After all the air bubbles pass through the valve 54, the valve 54 is closed. Next, the pressure of the ink supply pump 52 is adjusted to discharge ink from the nozzles 11 and thereby to discharge air bubbles from the nozzles 11. Then, the ink supply pump 52 is opened to stop the flow of ink so that a negative pressure necessary to prevent ink from dripping is generated by the difference in the pressure head between the main tank 5 and the nozzles 11. The nozzle surface 11*a* is wiped by a wiping part (not shown) to remove ink on the nozzle surface 11*a* and to form menisci in the nozzles 11.

The above process makes it possible to discharge air bubbles from ink channels/paths and the ink containing part 22 and thereby makes it possible to improve the ink-jet performance.

Referring back to FIG. 1, two detection electrodes 29*a* and 29*b* for detecting that the amount of ink in the ink containing part 22 has become less than or equal to a predetermined amount are provided at the top of the sub tank 4. A control unit (not shown) for outputting a detection signal is provided at the ends of the detection electrodes 29*a* and 29*b*. The control unit and the detection electrodes 29*a* and 29*b* constitute a liquid amount sensor. The continuity (or the conduction state) between the detection electrodes 29*a* and 29*b* changes depending on whether both of the detection electrodes 29*a* and 29*b* are dipped in the ink or at least one of the detection electrodes 29*a* and 29*b* is out of the ink. The liquid amount sensor detects that the amount of ink in the ink containing part 22 has become less than or equal to the predetermined amount based of the change in the continuity between the detection electrodes 29*a* and 29*b*.

The liquid amount sensor also makes it possible to reliably detect whether air bubbles are in the ink containing part 22, whether the ink containing part 22 has been filled with ink in the ink supply process, and whether air bubbles in the ink containing part 22 have been discharged.

In the ink supply process and the bubble discharging process described with reference to FIGS. 3 and 4, whether the ink or the air bubbles have passed through the valve 54 is determined based on the time elapsed after the valve 54 is opened or the ink supply pump 52 is driven. Since the liquid amount sensor makes it possible to determine when the ink containing part 22 has been filled with ink, whether the ink or the air bubbles have passed through the valve 54 can be determined based on the time elapsed after the ink containing part 22 is filled with ink. Therefore, using the liquid amount sensor makes it possible to more reliably supply ink and discharge air bubbles, and thereby makes it possible to improve the ink-jet performance.

The bubble discharging process described above is a maintenance process performed irregularly when air bubbles have accumulated near the top of the ink containing part 22. As described above, the sub tank 2 of this embodiment is configured such that the horizontal cross sectional area of the ink containing part 22 decreases gradually in a direction from the top surface 22*a* toward the bottom surface 22*c* and becomes the smallest at the bottom surface 22*c*. This configuration enables ink to flow even near the bottom surface 22*c* of the ink containing part 22 and thereby makes it possible to prevent stagnation of ink. This configuration makes it possible to prevent stagnation of ink in the ink containing part 22 through a normal bubble discharging process, and thereby eliminates the need to perform a dedicated maintenance process to prevent stagnation of ink. This in turn eliminates the need to use ink for the maintenance process and thereby makes it possible to reduce the total printing cost.

Figure 5:
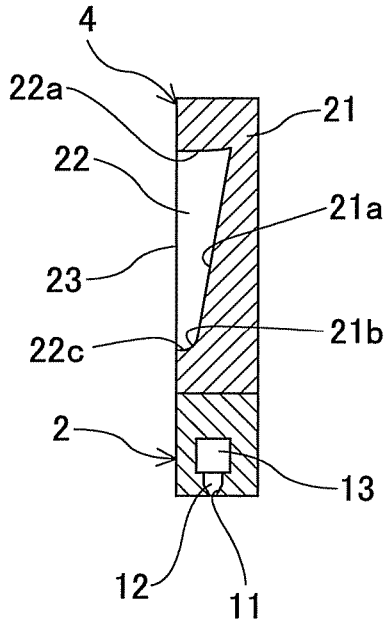
FIG. 5 is a cross-sectional view of a variation of the liquid-jet head unit shown in FIG. 1 taken along line A-A according to a second embodiment of the present invention.

Thus, according to the above embodiment, a liquid containing tank (the sub tank 4) includes a containing part (the ink containing part 22) including a first region and a second region, the flow speed of a liquid in the first region of the containing part is lower than the flow speed of the liquid in the second region of the containing part, and the horizontal cross sectional area of the first region of the containing part is less than the horizontal cross sectional area of the second region of the containing part. This configuration makes it possible to reduce stagnation of a liquid and thereby to stably supply the liquid Next, a second embodiment of the present invention is described with reference to FIG. 5. FIG. 5 is a cross-sectional view of a variation of the liquid-jet head unit 1 shown in FIG. 1 taken along line A-A.

In the second embodiment, a connecting portion 21*b* between the bottom surface 22*c* and the side surface 21*a* has a curved surface shape (has a curvature). This configuration removes angular corners from the ink containing part 22 and thereby makes it possible to allow ink to flow smoothly and to prevent stagnation of ink. Similar to the first embodiment, the horizontal cross sectional area of the ink containing part 22 is the smallest at the bottom surface 22*c*. This simple configuration makes it possible to reduce the costs of the liquid-jet head unit 1.

Figure 6:
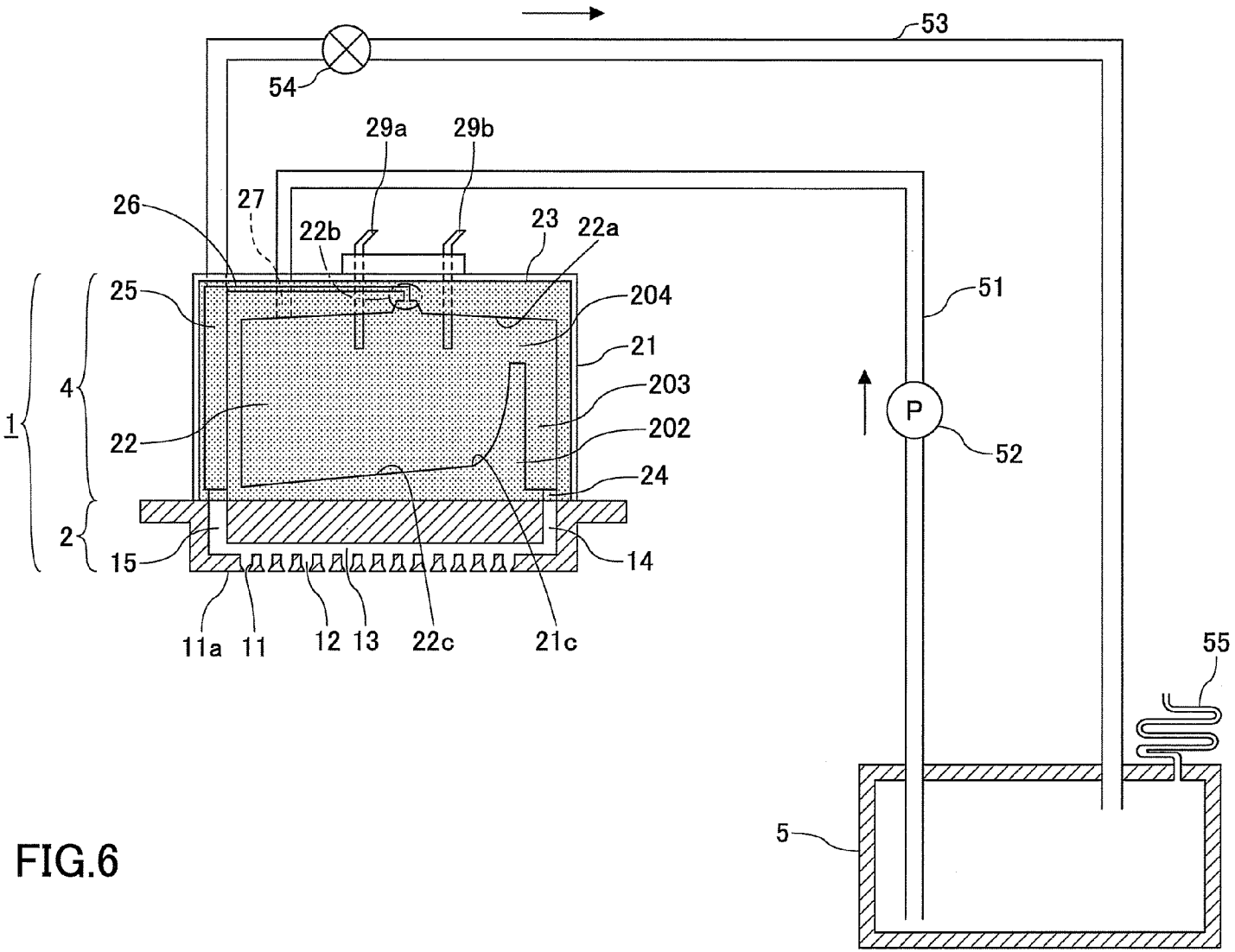
FIG. 6 is a drawing illustrating an ink supply system according to a third embodiment of the present invention.

Next, a third embodiment of the present invention is described with reference to FIG. 6. FIG. 6 is a drawing illustrating an ink supply system according to the third embodiment.

In the third embodiment, a connecting portion 21*c* connecting the partition wall 202 and the bottom surface 22*c* of the ink containing part 22 has a curved surface shape (has a curvature). Also, the bottom surface 22*c* of the ink containing part 22 slopes (or is inclined) so that the bottom surface 22*c* connects smoothly with the connecting portion 21*c*. In other words, the bottom surface 22*c* of the ink containing part 22 slopes upward toward the partition wall 202.

This configuration reduces the lowering of the flow speed of ink flowing near the bottom surface 22*c* of the ink containing part 22 into the ink supply path 203 which may be caused by the blockage of flow by the partition wall 202. Thus, the configuration of the third embodiment enables ink to flow smoothly in the ink containing part 22 and thereby makes it possible to prevent stagnation of ink.

The flow speed of ink in the ink containing part 22 can be determined by simulating the flow of liquid based on a numerical analysis. Also, the flow speed of ink in the ink containing part 22 can be determined by using an actual tank case 21. After a first ink is supplied to the ink containing part 22 by performing the ink supply process of FIG. 3, a second ink with the same density and a different color is put into the main tank 5 and the bubble discharging process of FIG. 4 or an ink jetting process is performed. As a result, the second ink with the different color is supplied from the main tank 5 to the ink containing part 22 and the color of ink in the ink containing part 22 gradually changes. In the ink containing part 22, the color of ink changes faster in a region where the flow speed is higher and the color of ink changes slower in a region where the flow speed is lower. Therefore, it is possible to determine the flow speeds of ink in the ink containing part 22 based on the rates of change in the color of ink. Using a transparent film as the dumper part 23 makes it easier to observe the ink in the ink containing part 22.

Figure 7:
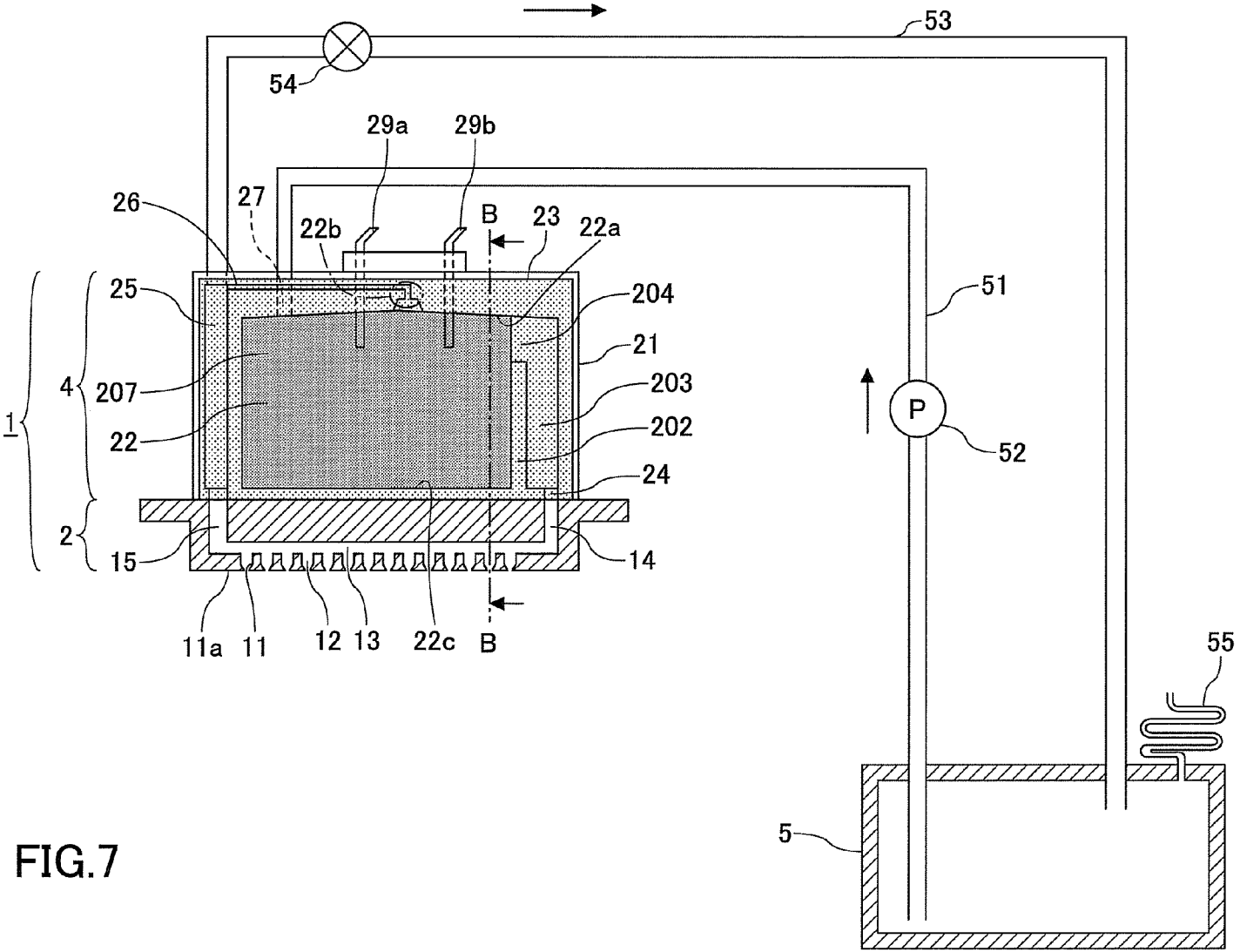
FIG. 7 is a drawing illustrating an ink supply system according to a fourth embodiment of the present invention.
Figure 8:
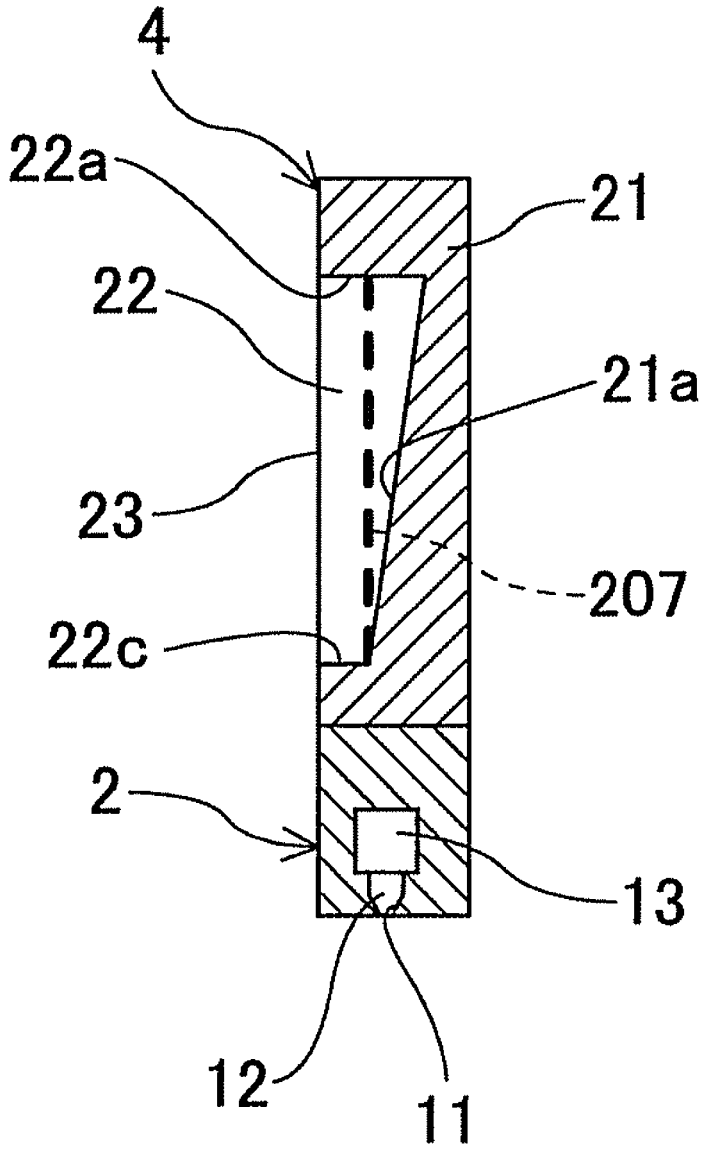
FIG. 8 is a cross-sectional view of a liquid-jet head unit shown in FIG. 7 taken along line B-B.

Next, a fourth embodiment of the present invention is described with reference to FIGS. 7 and 8. FIG. 7 is a drawing illustrating an ink supply system according to the fourth embodiment; and FIG. 8 is a cross-sectional view of a liquid-jet head unit 1 shown in FIG. 7 taken along line B-B.

In the fourth embodiment, a filter 207 for filtering impurities in ink is provided in the ink containing part 22 of the first embodiment. The filter 207 is disposed along the vertical section (facing the side surface 21*a*) of the ink containing part 22. As in the first embodiment, the horizontal cross sectional area of the ink containing part 22 decreases gradually in a direction from the top surface 22*a* toward the bottom surface 22*c* and becomes the smallest at the bottom surface 22*c*.

Ink flows via the ink supply channel port 27 into the ink containing part 22, passes through the filter 207, and then flows via the supply channel 203 into the head 2.

When ink is jetted from the head 2, additional ink flows via the ink supply channel port 27 into the ink containing part 22 and is supplied via the supply channel 203 to the head 2. Since the horizontal cross sectional area of the ink containing part 22 decreases gradually in a direction from the top surface 22*a* toward the bottom surface 22*c* and becomes the smallest at the bottom surface 22*c*, the ink flows at a certain flow speed even near the bottom surface 22*c* of the ink containing part 22. This applies also to the configuration of the fourth embodiment where the filter 207 is provided in the ink containing part 22 and therefore makes it possible to prevent stagnation of ink.

Figure 9:
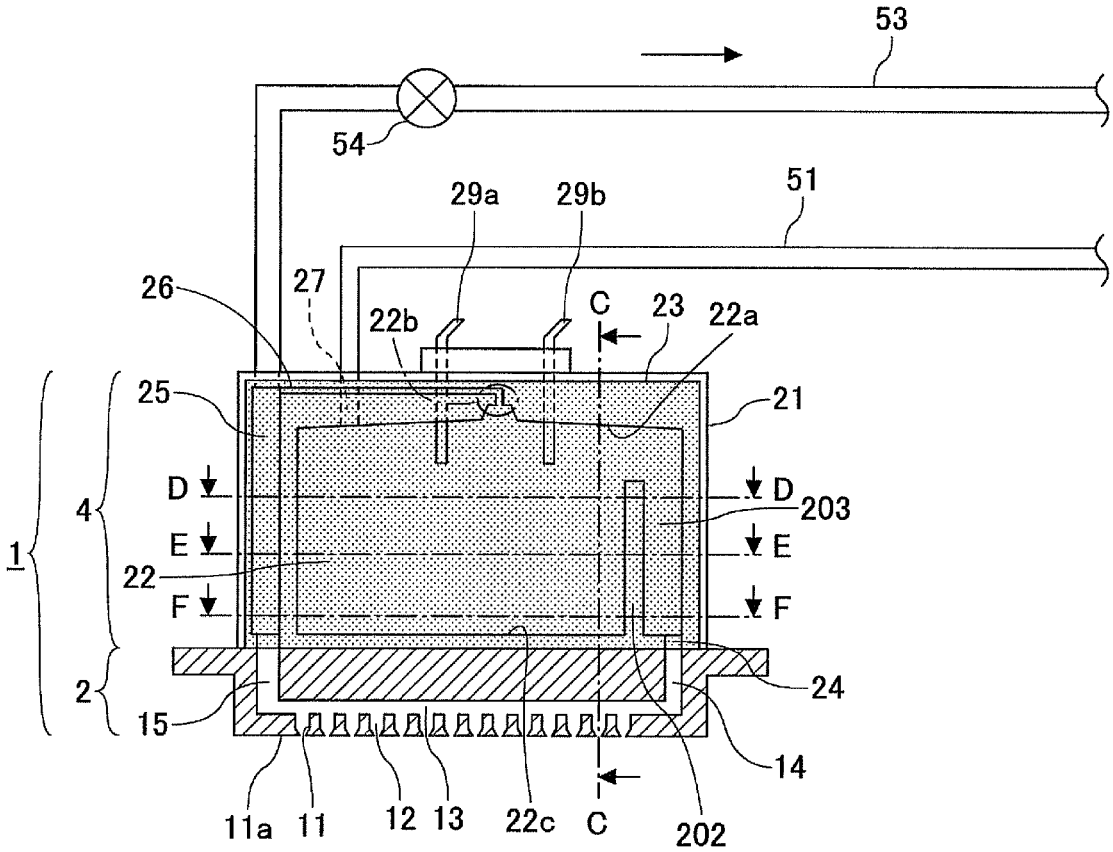
FIG. 9 is a drawing illustrating a liquid-jet head unit according to a fifth embodiment of the present invention.
Figure 10:
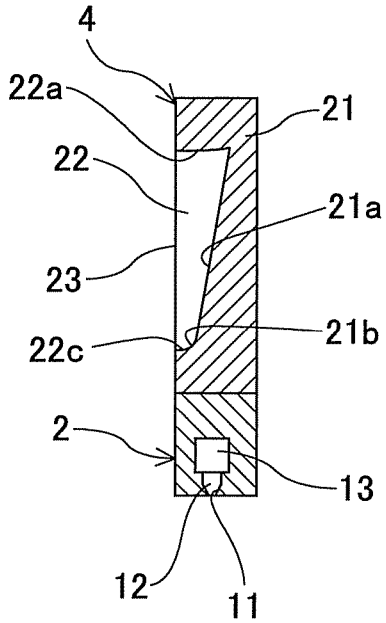
FIG. 10 is a cross-sectional view of the liquid-jet head unit shown in FIG. 9 taken along line C-C.
Figure 11A:
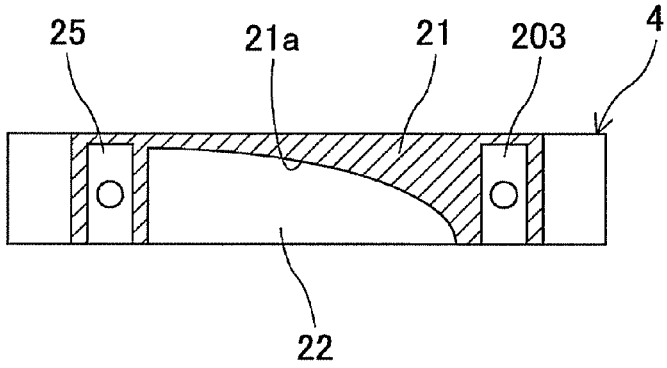
FIG. 11A is a cross-sectional view of a sub tank shown in FIG. 9 taken along line D-D.
Figure 11B:
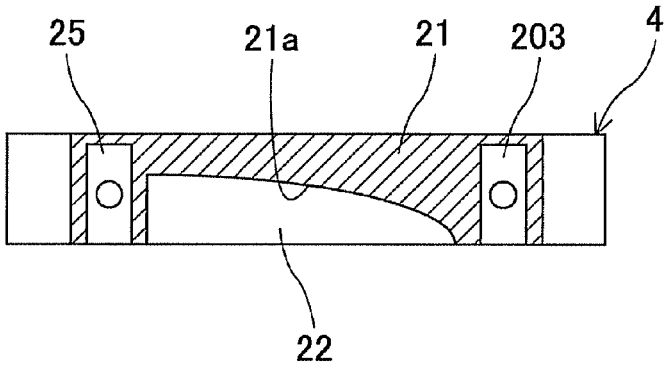
FIG. 11B is a cross-sectional view of the sub tank shown in FIG. 9 taken along line E-E.
Figure 11C:
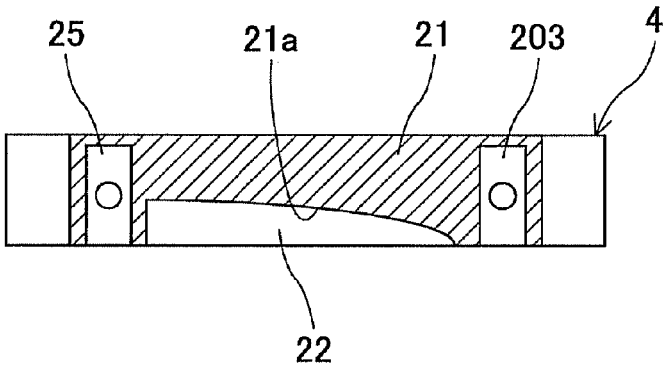
FIG. 11C is a cross-sectional view of the sub tank shown in FIG. 9 taken along line F-F.

Next, a fifth embodiment of the present invention is described with reference to FIGS. 9 through 11. FIG. 9 is a drawing illustrating a liquid-jet head unit 1 of the fifth embodiment. FIG. 10 is a cross-sectional view of the liquid-jet head unit 1 shown in FIG. 9 taken along line C-C. FIG. 11A is a cross-sectional view of a sub tank 4 shown in FIG. 9 taken along line D-D. FIG. 11B is a cross-sectional view of the sub tank 4 shown in FIG. 9 taken along line E-E. FIG. 11C is a cross-sectional view of the sub tank 4 shown in FIG. 9 taken along line F-F.

In the fifth embodiment, as shown by FIGS. 11A through 11C, the horizontal cross section of the ink containing part 22 is the largest near the ink supply channel port 27 where the flow speed of ink is the highest, and the horizontal cross section of the ink containing part 22 becomes smaller both in the direction toward the supply channel 203 and in the direction toward the bottom surface 22*c* where the flow speed of ink is the lowest. Changing the size of the horizontal cross section of the ink containing part 22 both in the horizontal and vertical directions according to the flow speed of ink as shown by FIGS. 11A through 11C makes it possible to more effectively prevent stagnation of ink in the ink containing part 22.

Figure 12:
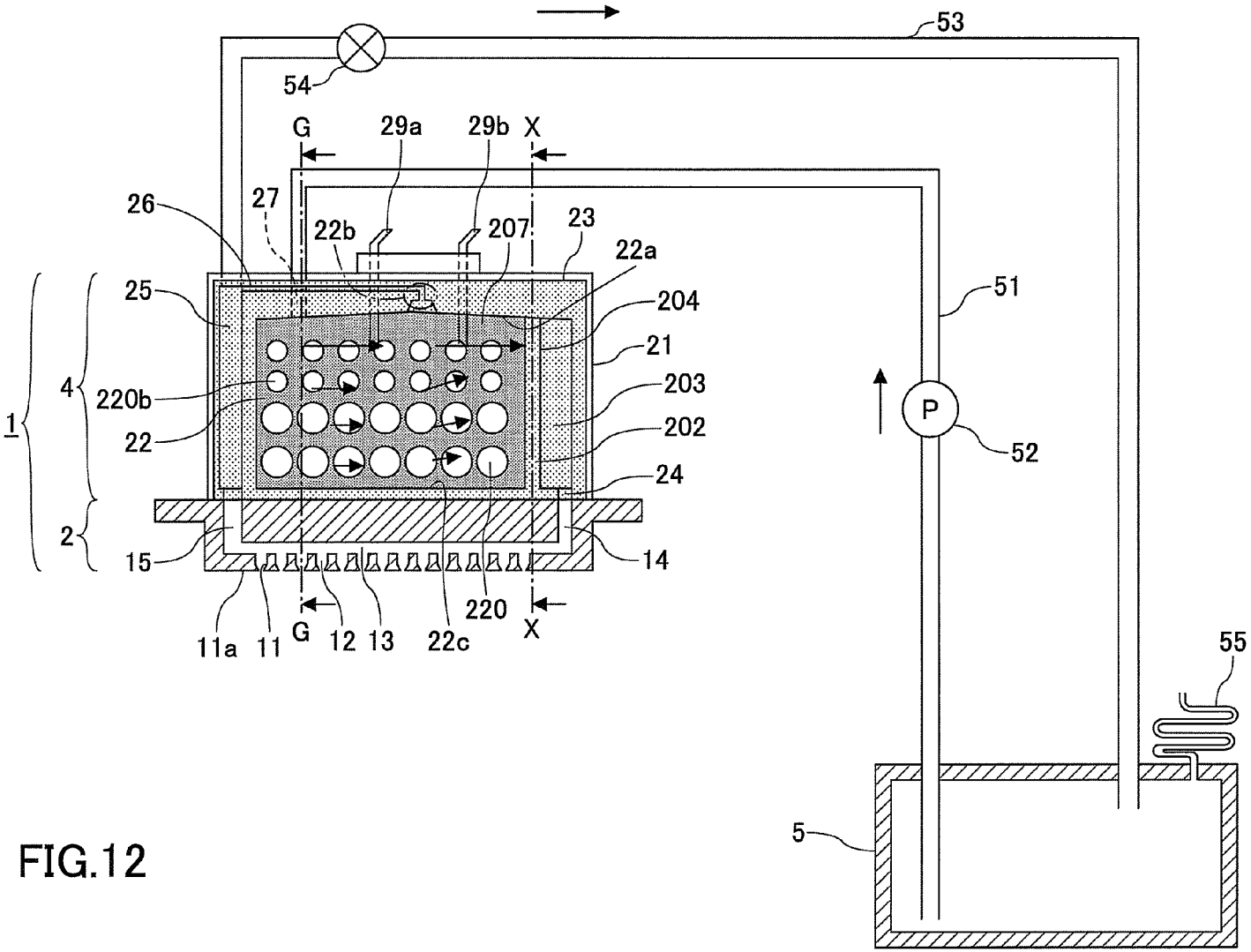
FIG. 12 is a drawing illustrating an ink supply system according to a sixth embodiment of the present invention.
Figure 13A:
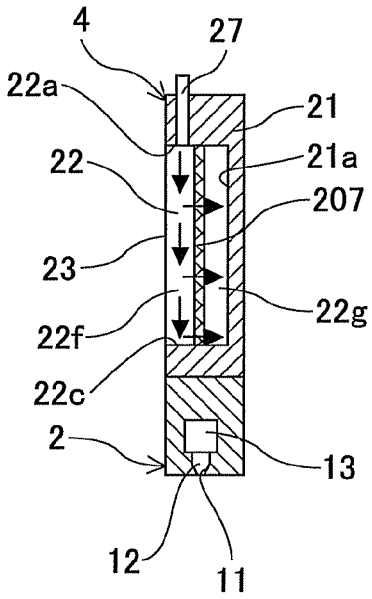
FIG. 13A is a cross-sectional view of a liquid-jet head unit shown in FIG. 12 taken along line G-G.
Figure 13B:
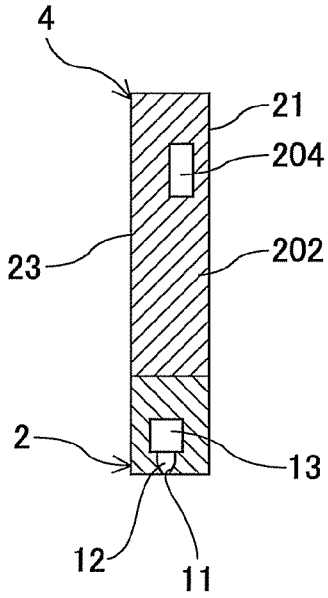
FIG. 13B is a cross-sectional view of a liquid-jet head unit shown in FIG. 12 taken along line X-X.

Next, a sixth embodiment of the present invention is described with reference to FIGS. 12, 13A, and 13B. FIG. 12 is a drawing illustrating an ink supply system according to the sixth embodiment; FIG. 13A is a cross-sectional view of a liquid-jet head unit 1 shown in FIG. 12 taken along line G-G; and FIG. 13B is a cross-sectional view of the liquid-jet head unit 1 shown in FIG. 12 taken along line X-X.

Different from the first through fifth embodiments, the recess forming the ink containing part 22 has a rectangular shape as shown in FIG. 13A. A filter 207 for filtering impurities in ink is disposed in the ink containing part 22 along the vertical section (facing the side surface 21*a*) of the ink containing part 22. The ink containing part 22 is divided by the filter 207 into a first chamber 22*f* where the ink supply channel port 27 is provided and a second chamber 22*g* where the communicating path 204 connecting the ink containing part 22 and the supply channel 203 is provided.

As shown in FIG. 12, the filter 207 has holes 220*a* and 220*b* that are smaller than the impurities to be removed and have different sizes. The diameter of the holes 220*a* near the bottom surface 22*c* of the ink containing part 22 where the flow speed of ink is lower is greater than the diameter of the holes 220*b* near the top surface 22*a* of the ink containing part 22 where the flow speed of ink is higher.

This configuration enables ink near the bottom surface 22*c* of the ink containing part 22 where the flow speed is low to smoothly pass through the filter 207 and thereby makes it possible to generate a sufficient ink flow even near the bottom surface 22*c* and to prevent stagnation of ink. In other words, this configuration makes it possible to prevent stagnation of ink in the ink containing part 22 through a normal ink jetting process and thereby eliminates the need to perform a dedicated maintenance process to prevent stagnation of ink.

Although holes with two different sizes are formed in the filter 207 of the sixth embodiment, the holes may have three or more different sizes.

Figure 14:
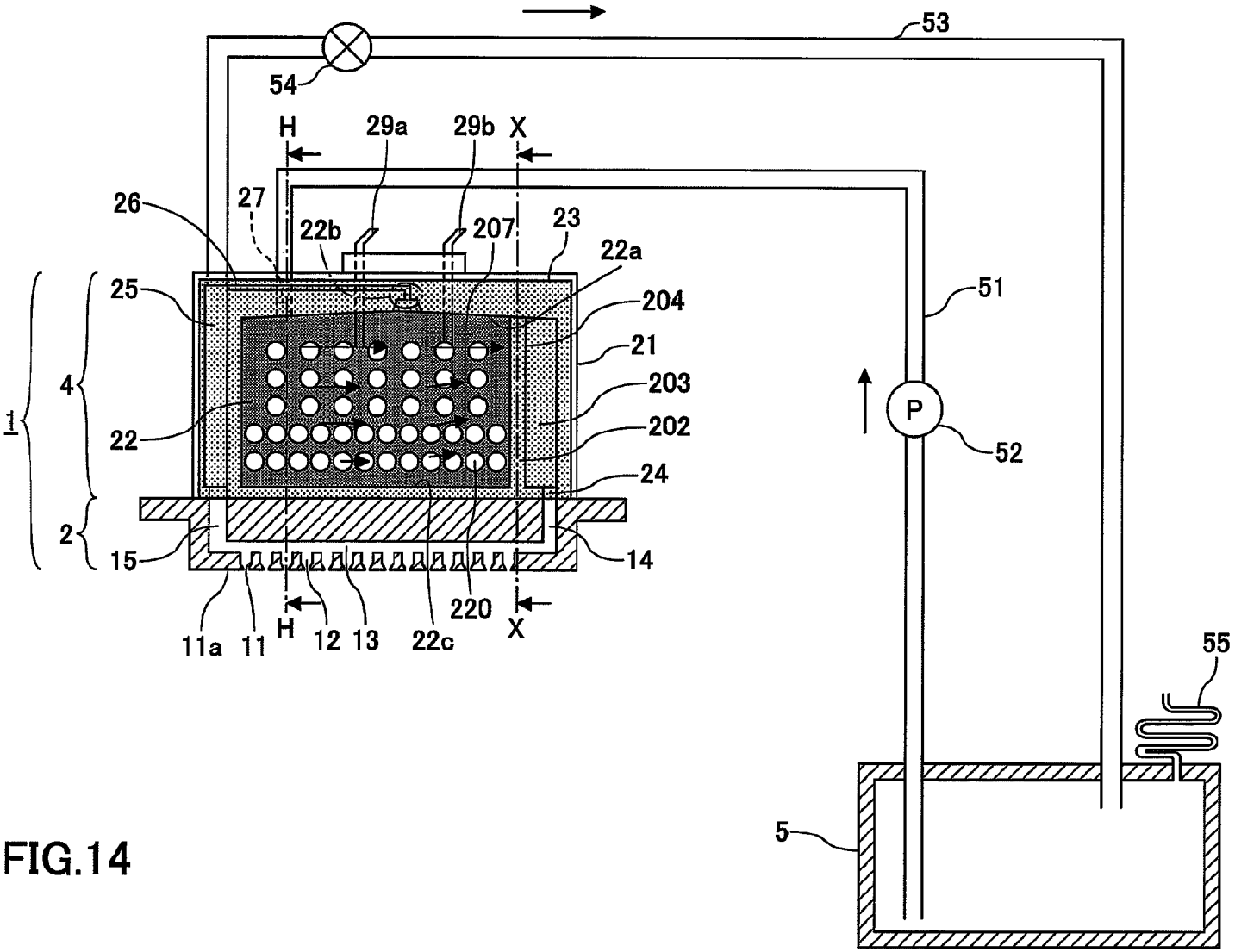
FIG. 14 is a drawing illustrating an ink supply system according to a seventh embodiment of the present invention.
Figure 15A:
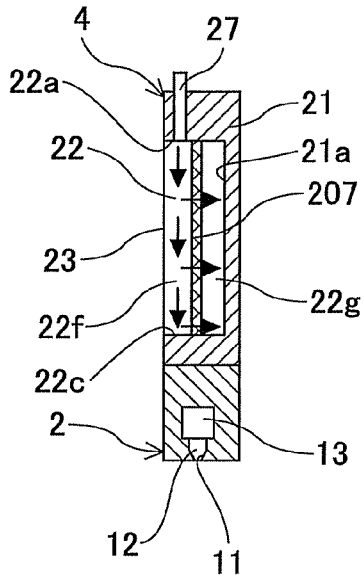
FIG. 15A is a cross-sectional view of a liquid-jet head unit shown in FIG. 14 taken along line H-H.
Figure 15B:
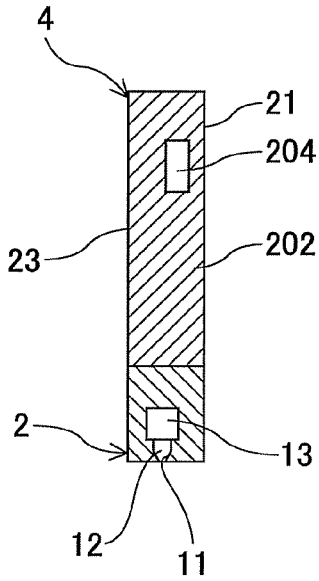
FIG. 15B is a cross-sectional view of a liquid-jet head unit shown in FIG. 14 taken along line X-X.

Next, a seventh embodiment of the present invention is described with reference to FIGS. 14 and 15. FIG. 14 is a drawing illustrating an ink supply system according to the seventh embodiment; FIG. 15A is a cross-sectional view of a liquid-jet head unit 1 shown in FIG. 14 taken along line H-H; and FIG. 15B is a cross-sectional view of the liquid-jet head unit 1 shown in FIG. 14 taken along line X-X.

The liquid-jet head unit 1 of the seventh embodiment has a configuration similar to that of the sixth embodiment. In the seventh embodiment, however, the number of holes 220 of the filter 207 near the bottom surface 22*c* is greater than the number of holes 220 near the top surface 22*a*. This configuration enables ink near the bottom surface 22*c* of the ink containing part 22 where the flow speed is low to smoothly pass through the filter 207 and thereby makes it possible to generate a sufficient ink flow even near the bottom surface 22*c* and to prevent stagnation of ink.

In other words, the aperture ratio of a portion of the filter 207 in a region of the ink containing part 22 where the flow speed of ink is lower is made greater than the aperture ratio of a portion of the filter 207 in a region of the ink containing part 22 where the flow speed of ink is higher. This configuration makes it possible to generate an ink flow with a sufficient speed even in a region where the flow speed of ink is relatively low and thereby makes it possible to prevent stagnation of ink.

In the sixth and seventh embodiments, it is assumed that the filter 207 is made of a single layer plate having holes. Alternatively, the filter 207 may include multiple layers where pores are formed by sintering. In this case, it is possible to achieve different aperture ratios in different portions of the filter 207 by changing the number of layers or by stacking layers with different pore sizes for the different portions of the filter 207 according to the distribution of the flow speed of ink in the ink containing part 22. Also, the filter 207 may be made by weaving fibers. In this case, it is possible to achieve different aperture ratios in different portions of the filter 207 by weaving fibers in different manners according to the distribution of the flow speed of ink in the ink containing part 22. These configurations also enable smooth flow of ink in the ink containing part 22 and thereby make it possible to prevent stagnation of ink.

Figure 16:
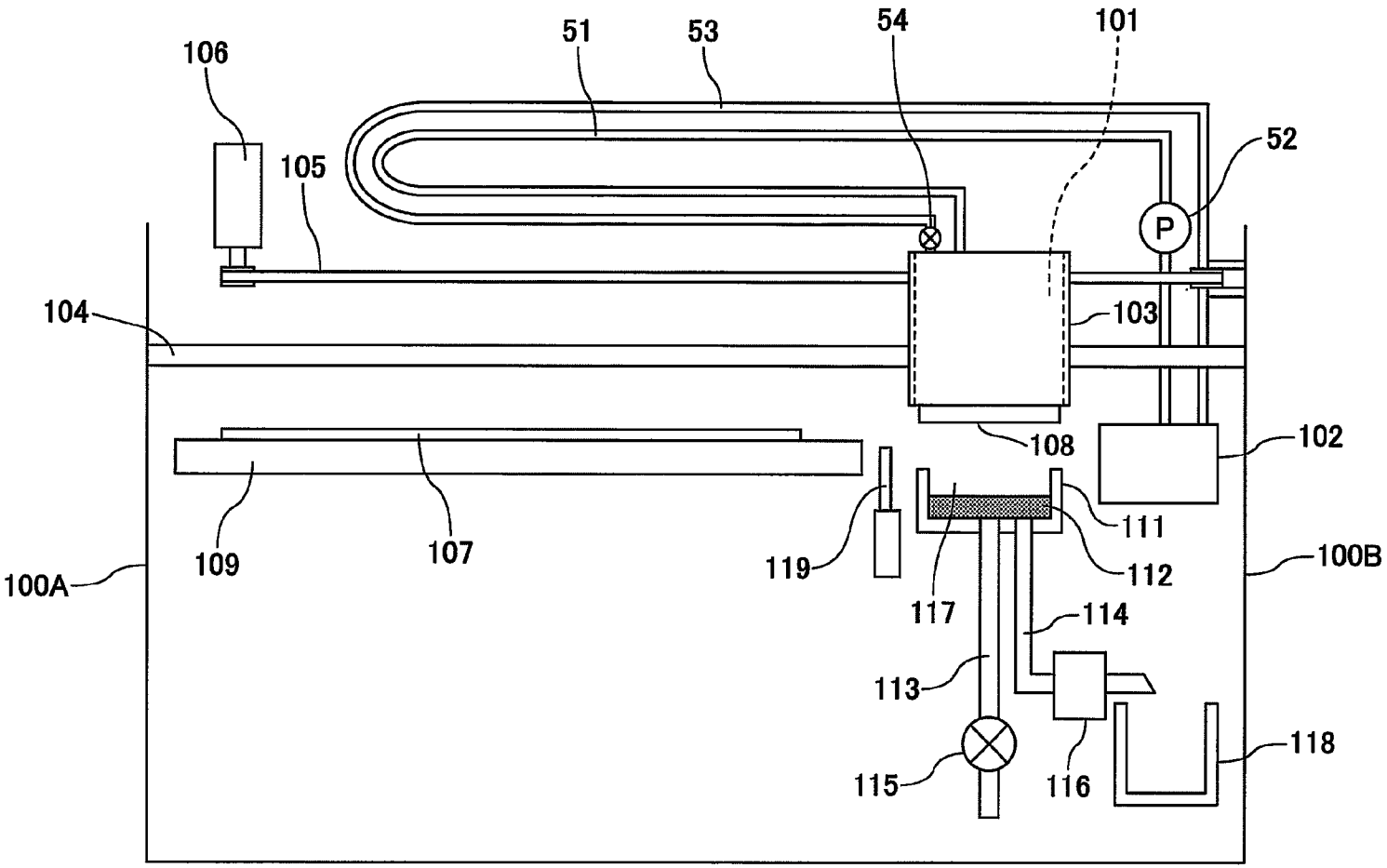
FIG. 16 is a drawing illustrating an image forming apparatus according to an embodiment of the present invention.

An image forming apparatus including an ink supply system according to one of the above embodiments is described below with reference to FIG. 16.

The image forming apparatus includes a recording head 101 that is the liquid-jet head unit 1 of one of the above embodiments. The recording head 101 is mounted on a carriage 103 that is slidably supported by a primary guide rod 104 extended laterally between side boards 100A and 100B and a secondary guide part (not shown). The recording head 101 is moved in the main-scanning direction by a main-scanning motor 106 via a timing belt 105. A conveying roller 109 conveys a recording medium 107 at a position facing a nozzle surface 108 of the recording head 101 in a direction orthogonal to the moving direction of the recording head 101. The recording head 101 jets ink droplets onto the recording medium 107 according to image data and thereby forms an image on the recording medium 107.

A main tank unit 102 including the main tank 5 and the atmospheric vent tube 55 supplies ink via the supply pump 52 and the flexible ink supply channel 51 to the recording head 101. Ink that has not been jetted or discharged from the nozzles 11 of the recording head 101 is returned via the ink return channel 53 to the main tank unit 102.

A capping part 111 is provided in a non-recording area. The capping part 111 caps the nozzle surface 108 including the nozzles 11 and is made of, for example, an elastic material such as silicon rubber. While no image is being recorded, the recording head 101 is moved to a position above the capping part 111 and the capping part 111 is moved by a cap moving mechanism (not shown) to cap the nozzle surface 108. An ink absorbing sheet 112 is provided in the capping part 111 to make it easier to suction ink from the nozzles 11 and to moisturize the air in the capping part 111.

Two tubes 113 and 114 are connected to the bottom of the capping part 111. The tube 113 communicates with the atmosphere via an atmospheric vent valve 115. The tube 114 is connected to a suction pump 116. With the nozzle surface 108 capped with the capping part 111 and the atmospheric vent valve 115 closed, the suction pump 116 is driven to generate a negative pressure in the capping part 111 and thereby to suction ink from the nozzles 11 of the recording head 101. Then, the atmospheric vent valve 115 is opened to discharge the ink accumulated in a space 117 in the capping part 111 into a waste-liquid tank 118. The capping part 111 is also kept in contact with the nozzle surface 108 of the recording head 101 with the atmospheric vent valve 115 closed to prevent drying of the nozzles 11.

The image forming apparatus also includes a wiper blade (wiping part) 119. The wiper blade 119 is moved by a wiper moving mechanism (not shown) to a height where the wiper blade 119 contacts the nozzle surface 108 of the recording head 101, and the recording head 101 is moved in the main-scanning direction to remove ink and dusts on the nozzle surface 108 and thereby to generate menisci in the nozzles 11.

In this embodiment, the image forming apparatus is implemented as a printer. However, the present invention may also be applied to other types of image forming apparatuses such as a facsimile machine, a copier, and a multifunction peripheral having functions of a printer, a facsimile machine, and a copier.

The present invention is not limited to the specifically disclosed embodiments, and variations and modifications may be made without departing from the scope of the present invention.

The present application is based on Japanese Priority Application No. 2009-269876, filed on Nov. 27, 2009, the entire contents of which are hereby incorporated herein by reference.

What is claimed is:

1. A liquid containing tank containing a liquid to be supplied to a liquid-jet head, the liquid containing tank comprising:

a containing part configured to contain the liquid supplied from an outside;

a supply port provided at the bottom of the containing part and configured to supply the liquid from the containing part to the liquid-jet head;

a discharge port provided at the bottom of the containing part and configured to lead the liquid discharged from the liquid-jet head to the containing part;

a partition wall rising from a bottom surface of the containing part and preventing a flow of the liquid between the containing part and the supply port; and a supply channel separated from the containing part by the partition wall and supplying the liquid from the containing part to the supply port, wherein the liquid containing tank has a recess formed therein and an opening of the recess is closed by a flexible film to form at least a portion of the containing part;

the containing part includes a first region and a second region that is formed above the first region;

the supply port and the discharge port are provided at the first region;

a flow speed of the liquid in the first region is lower than a flow speed of the liquid in the second region; and a side inner surface of the containing part rising from the bottom surface of the containing part slopes upward so that a depth of the containing part, from the side inner surface to the flexible film, increases gradually toward a top surface of the containing part, and a horizontal cross sectional area of the first region of the containing part is less than a horizontal cross sectional area of the second region of the containing part.

2. The liquid containing tank as claimed in claim 1, wherein a side surface rising from the bottom surface of the containing part slopes upward such that a depth of the containing part increases toward a top surface of the containing part.

3. The liquid containing tank as claimed in claim 1, wherein the bottom surface of the containing part slopes upward toward the partition wall separating the containing part and the supply channel.

4. The liquid containing tank as claimed in claim 1, wherein the containing part includes a filter for filtering the liquid; and portions of the filter corresponding to the first region and the second region of the containing part have different fluid resistances.

5. The liquid containing tank as claimed in claim 4, wherein the filter has holes; and a site of the holes in a portion of the filter corresponding to the first region of the containing part is greater than a size of the holes in another portion of the filter corresponding to the second region of the containing part.

6. The liquid containing tank as claimed in claim 4, wherein the filter has holes; and a number of the holes in a portion of the filter corresponding to the first region of the containing part is greater than a number of the holes in another portion of the filter corresponding to the second region of the containing part.

7. A liquid-jet head unit, comprising:

a liquid-jet head configured to jet liquid droplets; and the liquid containing tank of claim 1.

8. An image forming apparatus, comprising:

the liquid-jet head unit of claim 7.

9. The image forming apparatus of claim 8, further comprising:

a main tank to supply the liquid via a supply path to the liquid containing tank.

10. An image forming apparatus, comprising:

a liquid-jet head configured to jet liquid droplets; and the liquid containing tank of claim 1.

11. The image forming apparatus of claim 10, further comprising:

a main tank to supply the liquid via a supply path to the liquid containing tank.

* * * * *